US009373281B2

(12) United States Patent
Wu et al.

(10) Patent No.: US 9,373,281 B2
(45) Date of Patent: Jun. 21, 2016

(54) PIXEL UNIT CIRCUIT, COMPENSATING METHOD THEREOF AND DISPLAY DEVICE

(71) Applicant: BOE TECHNOLOGY GROUP CO., LTD., Beijing (CN)

(72) Inventors: Zhongyuan Wu, Beijing (CN); Liye Duan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 104 days.

(21) Appl. No.: 14/348,720

(22) PCT Filed: Jun. 26, 2013

(86) PCT No.: PCT/CN2013/077965

§ 371 (c)(1),
(2) Date: Mar. 31, 2014

(87) PCT Pub. No.: WO2014/172992

PCT Pub. Date: Oct. 30, 2014

(65) Prior Publication Data

US 2015/0339974 A1 Nov. 26, 2015

(30) Foreign Application Priority Data

Apr. 26, 2013 (CN) ..... 2013 1 0150519

(51) Int. Cl.
*G09G 5/10* (2006.01)
*G09G 3/32* (2016.01)
*G09G 3/20* (2006.01)

(52) U.S. Cl.
CPC ..... *G09G 3/3233* (2013.01); *G09G 3/2003* (2013.01); *G09G 2300/0819* (2013.01);
(Continued)

(58) Field of Classification Search
CPC ..... G09G 3/3233; G09G 3/2003; G09G 2310/0289; G09G 2320/045; G09G 2300/0842; G09G 2300/0861; G09G 2300/0819; G09G 2320/0233; G09G 2310/0248; G09G 2320/043
See application file for complete search history.

(56) References Cited

U.S. PATENT DOCUMENTS

2005/0017934 A1* 1/2005 Chung ..... G09G 3/3233 345/82
2005/0237281 A1 10/2005 Tam
(Continued)

FOREIGN PATENT DOCUMENTS

CN 101697268 A 4/2010
(Continued)

OTHER PUBLICATIONS machine translation of specification of CN102956201.*
(Continued)

*Primary Examiner* — Aneeta Yodichkas
*Assistant Examiner* — Joseph Fox
(74) *Attorney, Agent, or Firm* — Ladas & Parry LLP

(57) ABSTRACT

A pixel unit circuit, a compensating method thereof and a display device. The pixel unit circuit includes a driving transistor, a first transistor, a second transistor, a third transistor, a fourth transistor, a storage capacitor and a light-emitting device (OLED). The pixel unit circuit, the compensating method thereof and the display device may compensate the light emitting device by combining an internal compensation and an external compensation, and have advantages of both the internal compensation and the external compensation. The Mura phenomenon caused by non-uniformity in threshold voltages or drifts of threshold voltages in the N-type depletion or enhanced driving transistor TFT may be eliminated effectively by the internal compensation, which may enhance a display effect. Additionally, the pixel unit circuit, the compensating method thereof and the display device may have a function for extracting characteristics of the driving TFT and characteristics of the light emitting device, which may be applicable to the external compensation driving effectively.

12 Claims, 7 Drawing Sheets

(52) U.S. Cl.
CPC ..... *G09G2300/0842* (2013.01); *G09G 2300/0861* (2013.01); *G09G 2310/0248* (2013.01); *G09G 2310/0289* (2013.01); *G09G 2320/0233* (2013.01); *G09G 2320/043* (2013.01); *G09G 2320/045* (2013.01)

(56) References Cited

U.S. PATENT DOCUMENTS

| | | | | |
|---|---|---|---|---|
| 2006/0152452 | A1* | 7/2006 | Hoppenbrouwers | G09G 3/3233 345/77 |
| 2007/0128583 | A1 | 6/2007 | Miyazawa | |
| 2012/0293482 | A1* | 11/2012 | Wu ..... | G09G 3/3233 345/212 |
| 2012/0306843 | A1* | 12/2012 | Wang ..... | G09G 3/3258 345/212 |

FOREIGN PATENT DOCUMENTS

| | | | |
|---|---|---|---|
| CN | 102651196 | A | 8/2012 |
| CN | 102956201 | A | 3/2013 |
| CN | 203179479 | U | 9/2013 |
| JP | 2006-301161 | A | 11/2006 |
| JP | 2009-015345 | A | 6/2007 |
| KR | 1020090048823 | A | 5/2009 |
| KR | 20120043301 | A | 5/2012 |

OTHER PUBLICATIONS

"A Self-compensated Voltage Programming Pixel Structure for Active-Matrix Organic Light Emitting Diodes" by S.M. Choi et al., International Display Workshop 2003, pp. 535-538 (2003).*

Korean Office Action Appl. No. 10-2014-7008519; Dated Mar. 23, 2015.

International Search Rport Appln. No. PCT/CN2013/077965; Dated Feb. 20, 2014.

First Chinese Office Action Appln. No. 201310150519.3; Dated Sep. 17, 2014.

International Preliminary Report on Patentability issued Oct. 27, 2015; PCT/CN2013/077965.

* cited by examiner

PIXEL UNIT CIRCUIT, COMPENSATING METHOD THEREOF AND DISPLAY DEVICE

TECHNICAL FIELD

The present disclosure relates to a field of display technique, and particularly, to a pixel unit circuit, a compensating method thereof and a display device.

BACKGROUND

As a current-type light-emitting device, Organic Light-Emitting Diodes (OLED) have been widely used in display devices with high performance. A traditional Passive Matrix OLED requires a shorter driving time for a single pixel as a display size increases, therefore a transient current should be increased and power consumption increases. Also, an application of a great current may lead to an over-large voltage drop on lines of nanometer Indium Tin Oxides (ITO), and cause an over-high operation voltage of the OLED, which may in turn decrease its efficiency. As compared, an Active Matrix OLED (AMOLED) may settle these problems perfectively by scanning input OLED currents progressively by means of switching transistors.

In a design for an array substrate of the AMOLED, a major problem needed to be settled is a non-uniformity in brightness among pixel unit circuits.

Firstly, the AMOLED constructs the pixel unit circuit with Thin-Film Transistors (TFTs) to provide a corresponding current to the OLED device. In the prior art, Low Temperature Poly-Silion TFTs (LTPS TFTs) or Oxide TFTs are generally used. As compared with a general amorphous-Si TFT, the LTPS TFT and the Oxide TFT have a higher mobility and a better stability, and is more suitable to be applied to the AMOLED display. However, because of the limitation of the crystallization process, there is a disadvantage of non-uniformity in electric parameters such as threshold voltages, the mobility and the like while manufacturing LTPS TFTs on a glass substrate with a large area. Such non-uniformity may be transformed as a current difference and a brightness difference among the OLED display devices, and be perceived by viewer, which is called as a Mura phenomenon. The Oxide TFT has a good uniformity in the process, but similar to the a-Si TFT, the threshold voltage of the Oxide TFT would drift when a voltage is applied for a long time and under a high temperature. Amounts of the drift in the thresholds of the TFTs in respective parts on a panel would be different because displayed contents are different, which may lead to difference in the display brightness. Because such difference relates to an image displayed previously, it is generally shown as an image sticking phenomenon.

Secondly, in the display application with a large size, a power supply voltage at a region close to a supply position of an ARVDD power supply is higher as compared with that at a region far away from the power position in the array substrate, because power lines on the array substrate have certain resistances and the driving current for all pixels are provided by the power supply (ARVDD), and such phenomenon is called as power supply drop (IR Drop). The IR Drop may also lead to the current differences among the different regions and in turn generate the Mura phenomenon as display, since the voltage of the ARVDD power supply is associated with the current. The LTPS process constructing the pixel unit with P-Type TFTs is sensitive to this problem especially, because its storage capacitor is connected between the ARVDD and gates of the driving transistors TFTs, and a gate-source voltage Vgs of the driving transistor TFT would be affected directly when the voltage of the ARVDD changes.

Thirdly, the OLED device may also cause the non-uniformity in the electric performance because of a non-uniformity in thicknesses of a mask during an evaporation process. For the a-Si or Oxide TFT process constructing the pixel unit with N-Type TFTs, its storage capacitor is connected between a gate of a driving transistor TFT and an anode of the OLED, and the gate-source voltages Vgs applied to the driving transistors TFT would be different actually if the voltages at the anodes of the respective OLEDs are different when a data voltage is transferred to the gates of the respective driving transistors TFTs, such that the different driving currents may cause the difference in the display brightness.

The AMOLED may be divided into three categories based on the driving types: a digital type, a current type and a voltage type. The digital type driving method may implement gray scales by a manner of controlling driving timing with the TFTs as switches without compensating the non-uniformity, but its operation frequency would increase doubled and redoubled as the display size grows, which leads to a great power consumption, and reach a physical limitation of the design within a certain range, therefore it is not suitable for the display application with the large size. The current type driving method may implement the gray scales by a manner of providing the driving transistors TFTs with currents having different values directly, and may compensate the non-uniformity of the driving transistors TFTs and the IR drop better, but when a signal having a low gray scale is written, a over-long writing time may be raised because a small current charges a big parasitic capacitor on a data line. Such problem is especially serious and even can not be overcome in the display with the large size. The voltage type driving method is similar to a driving method for the traditional Active Matrix Liquid Crystal Display (AMLCD) and provides a voltage signal representing the gray scale by a driving IC, and the voltage signal may be transformed to a current signal for the driving transistors inside the pixel circuit so as to drive the OLED to realize the luminance gray scales. Such method has advantages of a quick driving speed and simple implementation, which is suitable for driving the panel with the large size and widely used in industry, however it needs to design additional TFTs and capacitor devices to compensate the non-uniformity among the driving transistors TFTs, the IR Drop and the non-uniformity of OLEDs.

FIG. 1 illustrates a pixel unit circuit in the prior art. As illustrated in FIG. 1, the pixel unit circuit comprises two thin film transistors T2 and T1, and one capacitor C. The pixel unit circuit illustrated in FIG. 1 is a typical structure for a pixel circuit of a voltage driving type (2T1C). Wherein the thin film transistor T2 operates as a switching transistor, transfers a voltage on a data line to a gate of the thin film transistor T1, which operates as a driving transistor, and the driving transistor transforms the data voltage to a corresponding current to be supplied to an OLED device. The driving transistor T1 should be in a saturation zone when it operates normally, and provide a constant current during a scanning period for one row. The current may be expressed as follows:

$$I_{OLED} = \frac{1}{2}\mu_n \cdot C_{OX} \cdot \frac{W}{L} \cdot (V_{data} - V_{OLED} - V_{thn})^2.$$

Wherein $\mu_n$ is a mobility of carriers, $C_{OX}$ is a capacitance value of a capacitor in an oxide layer at the gate, $$\frac{W}{L}$$

is a width-length ratio of the transistor, $V_{data}$ is a signal voltage on the data line, $V_{OLED}$ is an operation voltage of the OLED, $V_{thn}$ is a threshold voltage of the driving transistor TFT, which is a positive value for an enhanced TFT and is a negative value for a depletion TFT. It can be seen from the above equation that the currents would be different if the $V_{thn}$ is different among the different pixel units. If the $V_{thn}$ of the driving transistor TFT in a pixel unit drifts as time elapses, the currents before and after drifting would be different and the image sticking may occur. Also, the difference in the current may be also caused by difference in the operation voltages of the OLEDs because of a non-uniformity in the OLED devices.

There are many pixel structures for compensating the non-uniformity of the $V_{thn}$, the drift of the $V_{thn}$ and the non-uniformity of the OLEDs, and they may be divided into two classes, an internal compensation and an external compensation, generally. The internal compensation is a compensation manner for, inside a pixel, storing information on the threshold voltage of the driving transistor TFT in the pixel with TFTs and a capacitor and feeding back the same to a bias voltage Vgs of the driving transistor TFT, and FIG. 2*a* is a pixel unit circuit constituted by enhanced TFTs with the internal compensation manner in the prior art, while FIG. 2*b* is a pixel unit circuit constituted by depletion TFTs with the internal compensation manner in the prior art. As illustrated in FIGS. 2*a* and 2*b*, the pixel unit circuit with the internal compensation manner in the prior art comprises a driving transistor, which is a thin film transistor, a gate and a source of the driving transistor are connected with each other, a drain of the driving transistor is connected with an anode of an OLED, and a cathode of the OLED is connected with a second power supply voltage ELVSS. Such structure is only applicable to the enhanced TFT, but for the depletion TFT, the TFT is still turned on when a voltage at the gate of the TFT is 0, therefore the voltage stored through the TFT would not include any information on the $V_{thn}$ such that the non-uniformity in the $V_{thn}$ can not be compensated.

Another compensation manner is the external compensation, that is, its compensation manner is as follows: I-V characteristics of the driving transistor and I-V characteristics of the light-emitting device are read to an external sensing circuit by TFTs inside the pixel, driving voltage value required to be compensated is calculated and fed back to a chip in a driving panel. FIG. 3 is a pixel unit circuit with the external compensation manner in the prior art. As illustrated in FIG. 3, the pixel unit circuit with the external compensation manner in the prior art comprises: an Active Matrix Organic Light-Emitting Diode (AMOLED), a display row selector, a sensor row selector, a column readout, an image processing LSI, an Analog-Digital Convertor (ADC) and an ASIC Processor (AP). Wherein the ASIC Processor (AP) provides display data to the image processing LSI, the AMOLED comprises an array of pixel unit circuits and reads out the currents or voltages of the respective pixel unit circuits by the column readout. As illustrated in FIG. 3, a triangle frame between the column readout and the ADC represents an amplifying and compensating circuit. Given a data voltage as a reference voltage, when the voltage flowing out from the column readout is smaller than the reference voltage, it indicates that the voltage of the pixel unit circuit at this position is needed to be compensated, and the voltage from the column readout is compensated by the amplifying and compensating circuit, so that the voltage or current of the driving transistor and/or the OLED device in the corresponding pixel unit circuit may be compensated.

The internal compensation and the external compensation have their own advantages and disadvantages. Generally, the internal compensation may only compensate the non-uniformity and the drifts of the threshold voltages of the driving transistor TFTs under limitations of a limited space and a circuit structure, while the external compensation may compensate the non-uniformity in the threshold voltages and the non-uniformity in the mobility of the driving transistor TFTs, and may also compensate some nonideal factors such as an ageing of the OLED, by implementing complex algorithm by means of the external integrated circuit chip(s). However, a compensation range of the external compensation is limited, its compensating voltage can not exceed a maximum range for voltage on the data line (DATA), while an internal driving voltage obtained by the internal compensation circuit may exceed the maximum range for the voltage on the data line. If the internal compensation and the external compensation may be combined with each other, their advantages may be acquired together.

SUMMARY

The present disclosure provides a pixel unit circuit, a compensating method thereof and a display device, which may settle a problem in the pixel unit circuit of the prior art that an internal compensation and an external compensation can not to be combined, may settle a problem of non-uniformity in threshold voltages of driving transistors of light-emitting devices and the corresponding pixel unit circuits occurred when a compensation is performed, and may have an extraction function for circuit characteristics of the driving transistors and the light-emitting devices so as to help implementation of the external compensation and realize an object for eliminating the Mura phenomenon in the display device finally.

In embodiments of the present disclosure, there is provided a pixel unit circuit comprising a driving transistor, a first transistor, a second transistor, a third transistor, a fourth transistor, a storage capacitor and a light-emitting device, wherein, a drain of the driving transistor is connected with a source of the fourth transistor, a source thereof is connected with a drain of the third transistor, and a gate thereof is connected with a first terminal of the storage capacitor and a source of the first transistor;

a drain of the first transistor is connected with the source of the fourth transistor, the source thereof is connected with the gate of the driving transistor, and a gate thereof is connected with a scan control signal line;

a drain of the second transistor is connected with a data line, a source thereof is connected with the source of the driving transistor and the drain of the third transistor, and a gate thereof is connected with the scan control signal line;

the drain of the third transistor is connected with the source of the driving transistor, a source thereof is connected with an anode of the light-emitting device, and a gate thereof is connected with a light-emitting control signal line;

a drain of the fourth transistor is connected with a first power supply voltage, the source thereof is connected with the drain of the driving transistor and the drain of the first transistor, and a gate thereof is connected with a pre-charging control signal line;

the first terminal of the storage capacitor is connected with the gate of the driving transistor, and a second terminal thereof is connected with the first power supply voltage;

a cathode of the light-emitting device is connected with a second power supply voltage.

Further, in the pixel unit circuit according to the embodiments of the present disclosure, the light-emitting device is an Organic Light-Emitting Diode device.

Further, in the embodiments of the present disclosure, there is further provided a compensating method for the pixel unit circuit, comprising:

selecting a compensation manner according to an operation stage of a light-emitting device, wherein the compensation manner comprises an internal compensation manner and an external compensation manner;

compensating the light-emitting device with the internal compensation manner, if the light-emitting device is in an operation stage for light-emitting normally; and compensating the light-emitting device with the external compensation manner, if the light-emitting device is in an operation stage of a panel reset or an operation stage of an idle display between frames or rows.

Furthermore, in the compensating method for the pixel unit circuit according to the embodiments of the present disclosure, said compensating the light-emitting device with the internal compensation manner further comprises:

pre-charging the driving transistor;

performing a voltage compensation or a current compensation on the driving transistor; and performing a voltage compensation or a current compensation on the light-emitting device, in order to remain the light-emitting device to emit light.

Furthermore, in the compensating method for the pixel unit circuit according to the embodiments of the present disclosure, said pre-charging the driving transistor further comprises:

setting a light-emitting control signal as a low level to turn off the third transistor; setting a pre-charging control signal as a high level to turn on the fourth transistor; setting a scan control signal as a high level to turn on the first transistor and the second transistor; and making a voltage at the source of the driving transistor be a voltage $V_{DATA}$ on the data line.

Furthermore, in the compensating method for the pixel unit circuit according to the embodiments of the present disclosure, said performing a voltage compensation or a current compensation on the driving transistor further comprises:

setting a light-emitting control signal as a low level to turn off the third transistor; setting a pre-charging control signal as a low level to turn off the fourth transistor; setting a scan control signal as a high level to turn on the first transistor and the second transistor; and making a voltage at the gate of the driving transistor be $V_{DATA}+V_{thn}$, wherein $V_{DATA}$ is the voltage on the data line, and $V_{thn}$ is a threshold voltage of the driving transistor.

Furthermore, in the compensating method for the pixel unit circuit according to the embodiments of the present disclosure, said performing a voltage compensation or a current compensation on the light-emitting device in order to remain the light-emitting device to emit light further comprises:

setting a light-emitting control signal as a high level to turn on the third transistor; setting a pre-charging control signal as a high level to turn on the fourth transistor; setting a scan control signal as a low level to turn off the first transistor and the second transistor; and making a current $I_{OLED}$ input to the light-emitting device through the driving transistor be:

$$I_{OLED} = \frac{1}{2} \cdot \mu_n C_{OX} \cdot \frac{W}{L} \cdot [V_{DATA} - V_{OLED}]^2,$$

wherein $\mu_n$ is a mobility of carriers, $C_{OX}$ is a capacitance value of the storage capacitor in an oxide layer at the gate, $$\frac{W}{L}$$

is a width-length ratio of the driving transistor, $V_{DATA}$ is a voltage on the data line, $V_{OLED}$ is an anode voltage of the light-emitting device.

Furthermore, in the compensating method for the pixel unit circuit according to the embodiments of the present disclosure, said compensating the light-emitting device with the external compensation manner further comprises:

extracting a current from the driving transistor;

extracting a current from the light-emitting device; and detecting the current extracted from the driving transistor or the light-emitting device, and performing a voltage compensation or a current compensation on the light-emitting device according to a value of the detected current.

Furthermore, in the compensating method for the pixel unit circuit according to the embodiments of the present disclosure, said extracting a current from the driving transistor further comprises:

setting a light-emitting control signal as a low level to turn off the third transistor; setting a pre-charging control signal as a high level to turn on the fourth transistor; setting a scan control signal as a high level to turn on the first transistor and the second transistor; and enabling a current of the driving transistor to be input to the data line while shielding a current of the light-emitting device from being input to the data line.

Furthermore, in the compensating method for the pixel unit circuit according to the embodiments of the present disclosure, said extracting a current from the light-emitting device further comprises:

setting a light-emitting control signal as a high level to turn on the third transistor; setting a pre-charging control signal as a low level to turn off the fourth transistor; setting a scan control signal as a high level to turn on the first transistor and the second transistor; and enabling a current of the light-emitting device to be input to the data line while shielding a current of the driving transistor from being input to the data line.

Further, in the compensating method for the pixel unit circuit according to the embodiments of the present disclosure, the light-emitting device is an Organic Light-Emitting Diode device.

In the embodiments of the present disclosure, there is further provided a display device comprising the pixel unit circuit according to the embodiments of the present disclosure.

With the pixel unit circuit, the compensating method thereof and the display device according to the embodiments of the present disclosure, following benefit effects may be acquired.

First, the pixel unit circuit and the compensating method thereof according to the embodiments of the present disclosure may compensate the OLED device by combining the internal compensation and the external compensation, and have advantages of both the internal compensation and the external compensation. The Mura phenomenon caused by the non-uniformity in the threshold voltages or their drifts in the N-type depletion or enhanced driving transistor TFT may be eliminated effectively by the internal compensation, which may enhance a display effect. Additionally, the pixel unit circuit and the compensating method thereof according to the embodiments of the present disclosure may have a function for extracting characteristics of the driving TFT and characteristics of the OLED, which may be applicable to the external compensation driving effectively.

Second, the pixel unit circuit and the compensating method thereof according to the embodiments of the present disclosure may compensate a current difference among different regions caused by the IR drop and enhance the display effect.

Third, the display device according to the embodiments of the present disclosure may further eliminate the Mura phenomenon and enhance the display effect on the display device by utilizing the pixel unit circuit according to the embodiments of the present disclosure.

DETAILED DESCRIPTION

In order to understand the present disclosure better, the present disclosure would be described below in connection with accompanying drawings and embodiments of the present disclosure.

A pixel unit circuit according to the embodiments of the present disclosure is mostly used for a driving compensation of a light-emitting device OLED, driving for each of the light-emitting devices is compensated by one pixel unit circuit, and each of pixel unit circuits is structured by connecting 5 thin film transistors and 1 transistor to the light-emitting device. This structure may be used for both of an internal compensation and an external compensation. A display process for the internal compensation is divided into 3 sub-processes, and they are a precharging sub-process, a compensating sub-process and a displaying sub-process, respectively. The external compensation is divided into 2 sub-processes, and they are a current-extraction sub-process of a driving transistor TFT and a current-extraction sub-process of the light-emitting device, respectively. As compared the traditional pixel structure, the pixel unit circuit according to the embodiments of the present disclosure may compensate the drifts and non-uniformity in the threshold voltages of the enhanced-type or depletion-type driving transistor TFT, and the non-uniformity in the voltages and an ageing of the light-emitting device.

In the pixel unit circuit according to the embodiments of the present disclosure, the light-emitting device at its output terminal may be an AMOLED. The pixel unit circuit may eliminate the non-uniformity in the threshold voltages in the N-type depletion or enhanced driving transistor TFT effectively by the internal compensation, which may enhance a display effect. Additionally, the pixel unit circuit according to the embodiments of the present disclosure may have a function for extracting characteristics of the driving transistor TFT and characteristics of the light-emitting device, which may be applicable to the external compensation driving effectively. The light-emitting device herein refers to an OLED device, and the characteristics of the light-emitting device refer to voltage-current characteristics of the OLED device.

Figure 1:
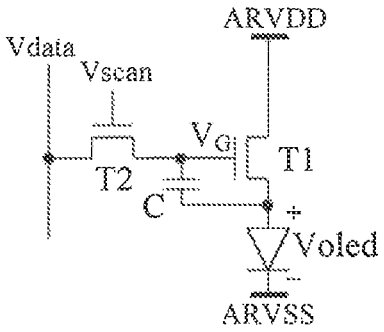
Fig.1 (Prior Art)
FIG. 1 is a pixel unit circuit in the prior art.
Figure 2:
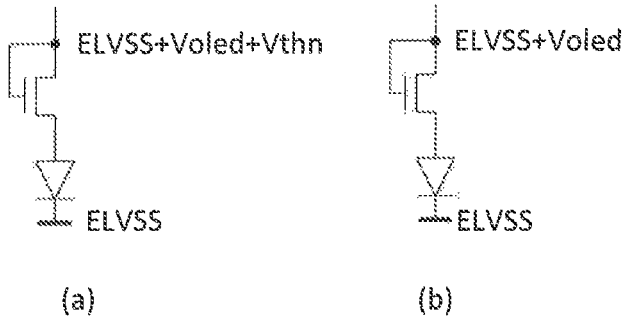
Fig.2 (Prior Art)
FIG. 2 is a pixel unit circuit with an internal compensation manner in the prior art.
Figure 3:
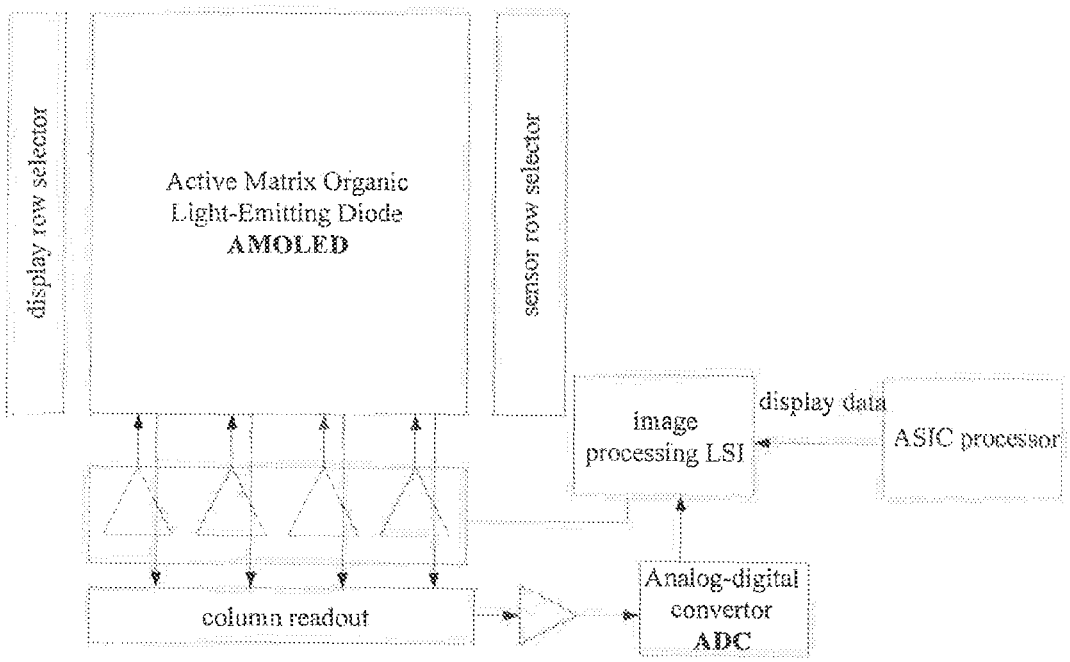
Fig.3 (Prior Art)
FIG. 3 is a pixel unit circuit with an external compensation manner in the prior art.
Figure 4:
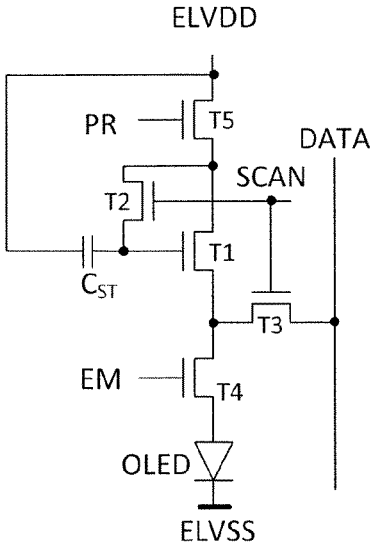
FIG. 4 is a circuit diagram illustrating a pixel unit circuit according to embodiments of the present disclosure.

FIG. 4 is a circuit diagram illustrating the pixel unit circuit according to embodiments of the present disclosure. As illustrated in FIG. 4, the pixel unit circuit according to the embodiments of the present disclosure comprises a driving transistor T1, a first transistor T2, a second transistor T3, a third transistor T4, a fourth transistor T5, a storage capacitor $C_{ST}$ and a light-emitting device, and the light-emitting device is an Organic Light-Emitting Diode OLED device.

The driving transistor T1 is used for driving the light-emitting device. In an example, a drain of the driving transistor T1 is connected with a source of the fourth transistor T5, a source thereof is connected with a drain of the third transistor T4, and a gate thereof is connected with a first terminal of the storage capacitor $C_{ST}$ and a source of the first transistor T2.

The first transistor T2 is a control switch for a scan control signal. In an example, a drain of the first transistor T2 is connected with the source of the fourth transistor T5, the source thereof is connected with the gate of the driving transistor T1, and a gate thereof is connected with a scan control signal line SCAN.

The second transistor T3 is another control switch for the scan control signal. In an example, a drain of the second transistor T3 is connected with a data line DATA, a source thereof is connected with the source of the driving transistor T1 and the drain of the third transistor T4, and a gate thereof is connected with the scan control signal line SCAN.

The third transistor T4 is a control switch for a light-emitting control signal. In an example, the drain of the third transistor T4 is connected with the source of the driving transistor T1, a source thereof is connected with an anode of the light-emitting device OLED, and a gate thereof is connected with a light-emitting control signal line EM.

The fourth transistor T5 is a control switch for a pre-charging control signal. In an example, a drain of the fourth transistor T5 is connected with a first power supply voltage ELVDD, the source thereof is connected with the drain of the driving transistor T1 and the drain of the first transistor T2, and a gate thereof is connected with a pre-charging control signal line PR.

The first terminal of the storage capacitor $C_{ST}$ is connected with the gate of the driving transistor T1, and a second terminal thereof is connected with the first power supply voltage ELVDD.

A cathode of the light-emitting device OLED is connected with a second power supply voltage ELVSS.

The second power supply voltage ELVSS is a voltage supplied to the cathode of the light-emitting device, and is within a range between −5V to 0V generally and may be acquired by an actual test.

Figure 5:
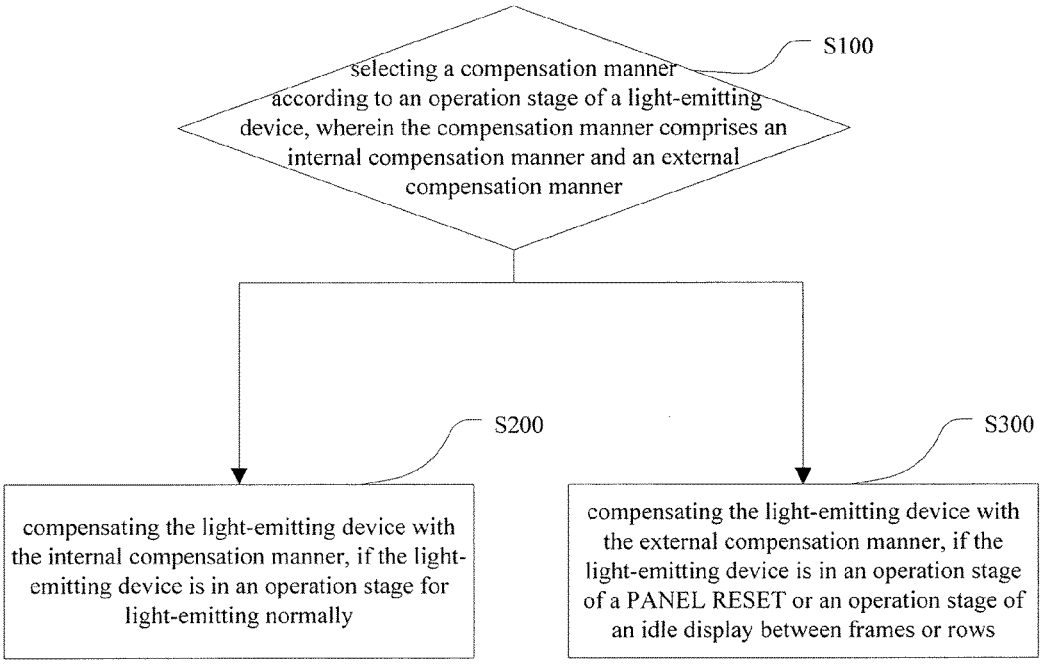
FIG. 5 is a flowchart illustrating a compensating method for the pixel unit circuit according to the embodiments of the present disclosure.

Further, FIG. 5 is a flowchart illustrating a compensating method for the pixel unit circuit according to the embodiments of the present disclosure, as illustrated in FIG. 5, the method comprises:

at a step S100, selecting a compensation manner according to an operation stage of a light-emitting device, wherein the compensation manner comprises an internal compensation manner and an external compensation manner;

at a step S200, compensating the light-emitting device with the internal compensation manner, if the light-emitting device is in an operation stage for light-emitting normally; and at a step S300, compensating the light-emitting device with the external compensation manner, if the light-emitting device is in an operation stage of a PANEL RESET or an operation stage of an idle display between frames or rows, which may be considered as abnormal operation stages, wherein the light-emitting device is an Organic Light-Emitting Diode device OLED.

Figure 6:
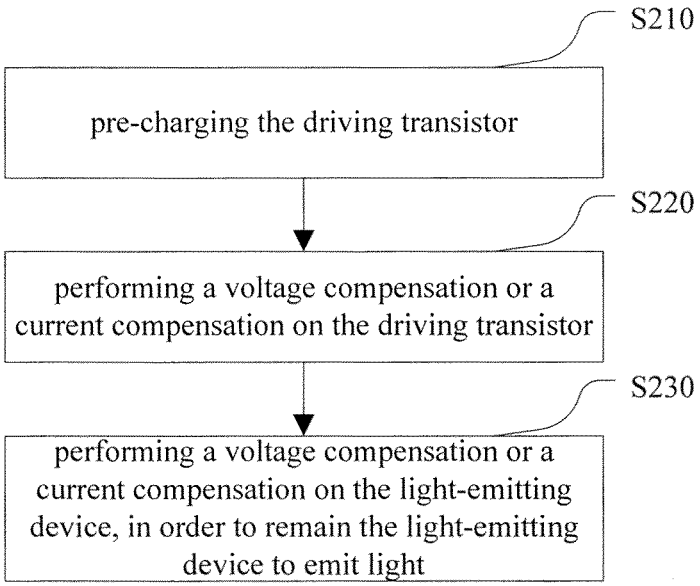
FIG. 6 is a flowchart illustrating the compensating method for the pixel unit circuit under the internal compensation manner according to the embodiments of the present disclosure.

Furthermore, FIG. 6 is a flowchart illustrating the compensating method for the pixel unit circuit under the internal compensation manner according to the embodiments of the present disclosure. As illustrated in FIG. 6, in the step S200, the step of compensating the light-emitting device with the internal compensation manner further comprises:

at a step S210, pre-charging the drain of the driving transistor;

at a step S220, performing a voltage compensation or a current compensation on the gate of the driving transistor; and at a step S230, performing a voltage compensation or a current compensation on the light-emitting device, in order to remain the light-emitting device to emit light.

Furthermore, in the compensating method for the pixel unit circuit according to the embodiments of the present disclosure, the step of pre-charging the drain of the driving transistor in the step S210 further comprises:

setting a light-emitting control signal EM as a low level to turn off the third transistor; setting a pre-charging control signal PR as a high level to turn on the fourth transistor; setting a scan control signal as a high level to turn on the first transistor and the second transistor; and making a voltage at the source of the driving transistor be a voltage $V_{DATA}$ on the data line.

Figure 7:
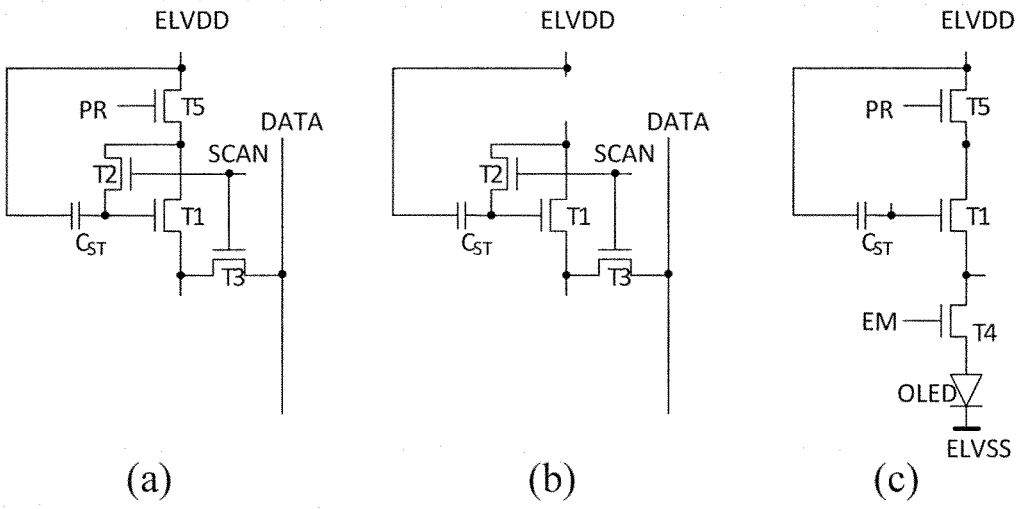
FIG. 7 is an equivalent circuit diagram illustrating the pixel unit circuit under the internal compensation manner according to the embodiments of the present disclosure.

FIG. 7 is an equivalent circuit diagram illustrating the pixel unit circuit under the internal compensation manner according to the embodiments of the present disclosure. As illustrated in (a) of FIG. 7, in a precharging stage: the driving transistor T1, the first transistor T2, the second transistor T3 and the fourth transistor T5 are turned on, and the third transistor T4 is turned off; the voltage on the data line is the signal voltage $V_{DATA}$ of a current frame on the data line, electronic charges stored in the capacitor $C_{ST}$ are released, so that the source of the driving transistor T1 is precharged to a high level, that is, the voltage $V_{DATA}$ on the data line.

Furthermore, in the compensating method for the pixel unit circuit according to the embodiments of the present disclosure, the step of performing a voltage compensation or a current compensation on the gate of the driving transistor in the step S220 further comprises:

setting the light-emitting control signal as a low level to turn off the third transistor; setting the pre-charging control signal as a low level to turn off the fourth transistor; setting the scan control signal as a high level to turn on the first transistor and the second transistor; and making a voltage at the gate of the driving transistor be $V_{DATA}+V_{thn}$, wherein $V_{DATA}$ is the voltage on the data line, and $V_{thn}$ is a threshold voltage of the driving transistor.

FIG. 7 is the equivalent circuit diagram illustrating the pixel unit circuit under the internal compensation manner according to the embodiments of the present disclosure. As illustrated in (b) of FIG. 7, in a compensating stage: the driving transistor T1, the first transistor T2 and the second transistor T3 are turned on, and the third transistor T4 and the fourth transistor T5 are turned off, the gate of the driving transistor T1 is discharged until the voltage at the gate of the driving transistor T1 is equal to $V_{DATA}+V_{thn}$, and at this time the transistor precharged is compensated, the electronic charges stored across the two terminals of the storage capacitor $C_{ST}$ are equal to $(V_{ELVDD}-V_{thn}-V_{DATA})*C_{ST}$, wherein $V_{ELVDD}$ is a voltage of the first power supply voltage ELVDD, $C_{ST}$ is a capacitance value of the storage capacitor $C_{ST}$ in the oxide layer at the gate, Vthn is the threshold voltage of the driving transistor T1, and $V_{DATA}$ is the signal voltage on the data line.

Furthermore, in the compensating method for the pixel unit circuit according to the embodiments of the present disclosure, the step of performing a voltage compensation or a current compensation on the light-emitting device in order to remain the light-emitting device to emit light in the step S230 further comprises:

setting the light-emitting control signal as a high level to turn on the third transistor; setting the pre-charging control signal as a high level to turn on the fourth transistor; setting the scan control signal as a low level to turn off the first transistor and the second transistor; and making a current $I_{OLED}$ input to the light-emitting device through the driving transistor be:

$$I_{OLED} = \frac{1}{2} \cdot \mu_n C_{OX} \cdot \frac{W}{L} \cdot [V_{DATA} - V_{OLED}]^2,$$

wherein $\mu_n$ is a mobility of carriers, $C_{OX}$ is a capacitance value of the storage capacitor in an oxide layer at the gate, $$\frac{W}{L}$$

is a width-length ratio of the driving transistor, $V_{DATA}$ is a voltage on the data line, $V_{OLED}$ is a voltage at an anode of the light-emitting device.

FIG. 7 is the equivalent circuit diagram illustrating the pixel unit circuit under the internal compensation manner according to the embodiments of the present disclosure. As illustrated in (c) of FIG. 7, the light-emitting device is the OLED device, and in a light-emitting stage: the driving transistor T1, the third transistor T4 and the fourth transistor T5 are turned on, and the first transistor T2 and the second transistor T3 are turned off, the storage capacitor $C_{ST}$ is connected between the gate of the driving transistor T1 and the first power supply voltage ELVDD and remains the voltage at the gate of the driving transistor T1 to be $V_{DATA}+V_{thn}$, wherein $V_{thn}$ is the threshold voltage of the driving transistor T1, and $V_{DATA}$ is the signal voltage at the data line; at this time, the data line is disconnected with the pixel unit circuit, the voltage at the source of the driving transistor T1 changes to $V_{OLED}$ as the current of the OLED device begins to be stable, and the voltage at the gate of the driving transistor T1 is remained as $V_{DATA}+V_{thn}$, so the current $I_{OLED}$ flowing through the thin film transistor T1 is as follows:

$$I_{OLED} = \frac{1}{2}\cdot\mu_n C_{OX}\cdot\frac{W}{L}\cdot[V_{DATA}+V_{thn}-V_{thn}-V_{OLED}]^2 = \frac{1}{2}\cdot\mu_n C_{OX}\cdot\frac{W}{L}\cdot[V_{DATA}-V_{OLED}]^2,$$

wherein $\mu_n$ is the mobility of carriers, $C_{OX}$ is the capacitance value of the storage capacitor $C_{ST}$ in the oxide layer at the gate, $$\frac{W}{L}$$

is the width-length ratio of the driving transistor T1, $V_{DATA}$ is the signal voltage on the data line, $V_{OLED}$ is the voltage at the anode of the OLED device, that is, the operation voltage of the OLED device, $V_{thn}$ is the threshold voltage of the driving transistor T1, which is the positive value for an enhanced TFT transistor and is a negative value for a depletion TFT transistor.

It can be seen from the above equation that the current flowing through the driving transistor is independent of its threshold voltage $V_{thn}$, and is also independent of the voltage across the light-emitting device, thus the effect caused by the non-uniformity in the threshold voltages and their drifts of the driving transistors is eliminated mainly. The pixel unit circuit according to the embodiments of the present disclosure may compensate the effect caused by the non-uniformity in the threshold voltages of the driving transistors both for the enhanced thin film transistor and for the depletion thin film transistor, therefore its applicability is wider.

Figure 8:
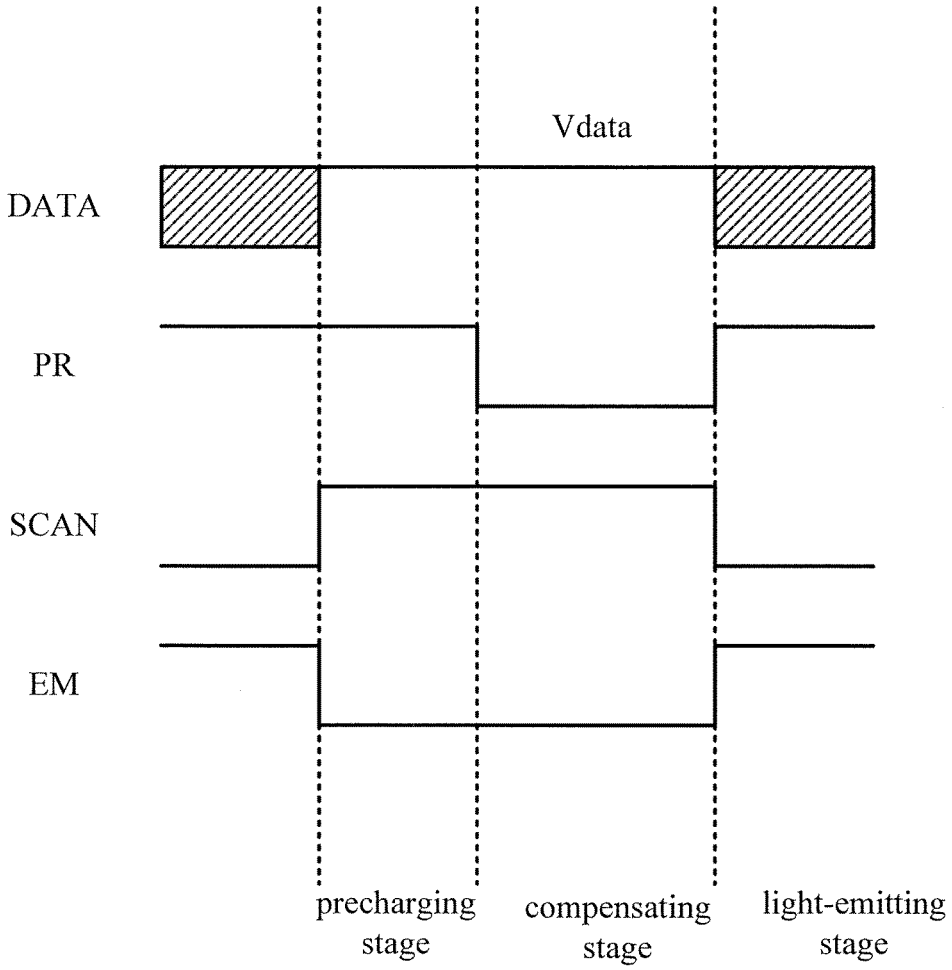
FIG. 8 is a control signal timing diagram of the compensating method for the pixel unit circuit under the internal compensation manner according to the embodiments of the present disclosure.

FIG. 8 is a control signal timing diagram of the compensating method for the pixel unit circuit under the internal compensation manner according to the embodiments of the present disclosure. As illustrated in FIG. 8, in the internal compensation, the control timings for the light-emitting control signal EM, the pre-charging control signal PR and the scan control signal SCAN are:

during the precharging stage, which corresponds to the step S210, the light-emitting control signal EM is in a low level, the pre-charging control signal PR and the scan control signal SCAN are in a high level;

during the compensating stage, which corresponds to the step S220, the light-emitting control signal EM and the pre-charging control signal PR are in a low level, and the scan control signal SCAN is in a high level; and during the light-emitting stage, which corresponds to the step S230, the light-emitting control signal EM and the pre-charging control signal PR are in a high level, and the scan control signal SCAN are in a low level.

Further, the compensating method for the pixel unit circuit according to the embodiments of the present disclosure further comprises compensating the light-emitting device under the external compensation manner. The external compensation occurs mainly during an operation stage of a PANEL RESET or during an operation stage of an idle display between frames or rows. For example, the PANEL RESET may occur at a moment of power on. The process of the external compensation is divided into two stages: the current extraction of the driving transistor and the current extraction of the light-emitting device.

Figure 9:
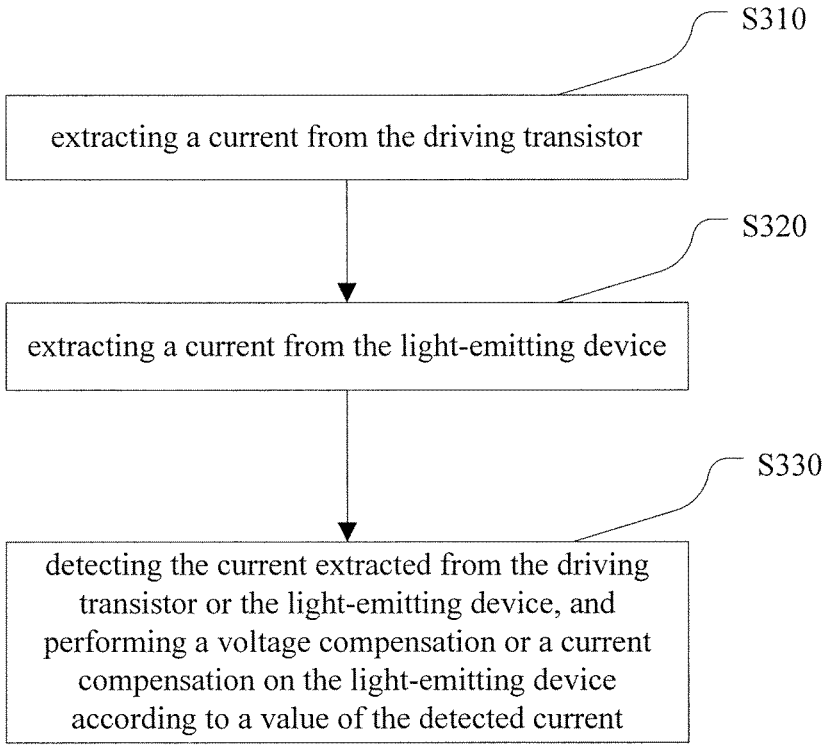
FIG. 9 is a flowchart illustrating the compensating method for the pixel unit circuit under the external compensation manner according to the embodiments of the present disclosure.

Further, FIG. 9 is a flowchart illustrating the compensating method for the pixel unit circuit under the external compensation manner according to the embodiments of the present disclosure. As illustrated in FIG. 9, in the step S300, the step of compensating the light-emitting device with the external compensation manner further comprises:

at a step S310, extracting a current from the driving transistor;

at a step of S320, extracting a current from the light-emitting device; and at a step S330, detecting the current extracted from the driving transistor or the light-emitting device, and performing a voltage compensation or a current compensation on the light-emitting device according to a value of the detected current.

Furthermore, in the compensating method for the pixel unit circuit according to the embodiments of the present disclosure, the step of extracting a current from the driving transistor in the step S310 further comprises:

setting a light-emitting control signal as a low level to turn off the third transistor; setting a pre-charging control signal as a high level to turn on the fourth transistor; setting a scan control signal as a high level to turn on the first transistor and the second transistor; and enabling a current of the driving transistor to be input to the data line while shielding a current of the light-emitting device from being input to the data line. A value of the current flowing through the driving transistor is detected by a sensing chip connected to the data line.

Figure 10:
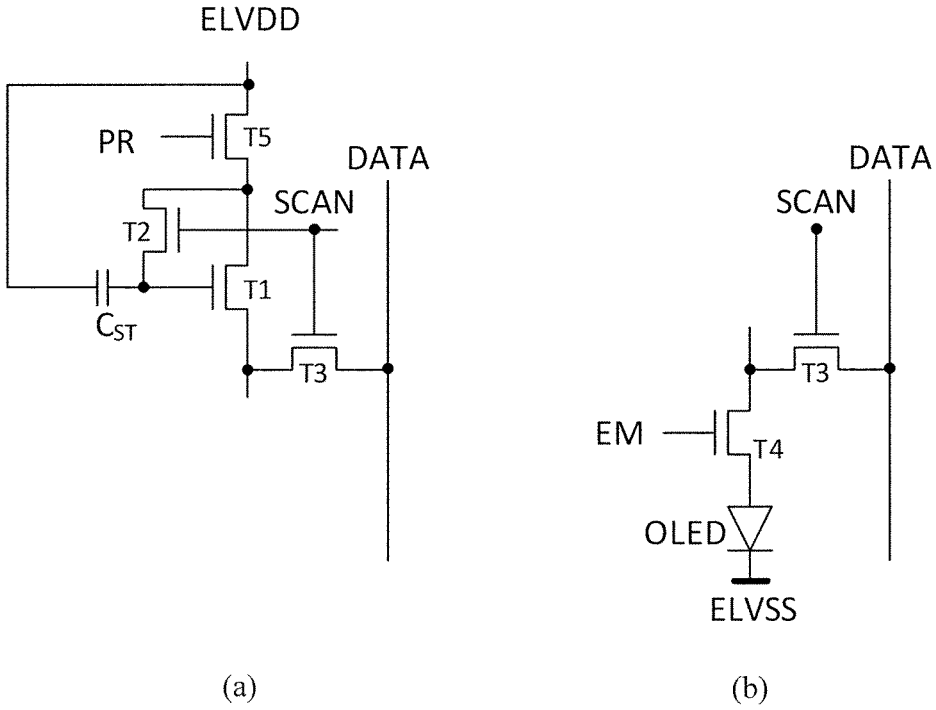
FIG. 10 is an equivalent circuit diagram illustrating the pixel unit circuit under the external compensation manner according to the embodiments of the present disclosure.

The voltage of the signal on the data line is denoted as a reference voltage $V_{REF}$, and $V_{REF}<V_{ELVDD}$, wherein $V_{ELVDD}$ is the voltage of the power supply ELVDD. FIG. 10 is an equivalent circuit diagram illustrating the pixel unit circuit under the external compensation manner according to the embodiments of the present disclosure. As illustrated in (a) of FIG. 10, the light-emitting device is the OLED device, the driving transistor T1, the first transistor T2, the second transistor T3 and the fourth transistor T5 are turned on, the third transistor T4 is turned off; at this time, the OLED device is disconnected with the driving transistor T1, the voltage between the gate and the source of the driving transistor T1 is biased as $V_{ELVDD}-V_{REF}$, and the driving current of the driving transistor T1 flows into the data line through the second transistor T3, so that the external sensing chip connected to the data line may sense this current value and perform further processing.

Furthermore, in the compensating method for the pixel unit circuit according to the embodiments of the present disclosure, the step of extracting a current from the light-emitting device in the step S320 further comprises:

setting the light-emitting control signal as a high level to turn on the third transistor; setting the pre-charging control signal as a low level to turn off the fourth transistor; setting the scan control signal as a high level to turn on the second transistor; and enabling a current of the light-emitting device to be input to the data line while shielding a current of the driving transistor from being input to the data line. The value of a current flowing through the light-emitting device is detected by the sensing chip connected to the data line.

The voltage of the signal on the data line is denoted as the reference voltage $V_{REF}$, and $V_{REF}>V_{thn}$, wherein $V_{thn}$ is the threshold voltage of the driving transistor T1. FIG. 10 is the equivalent circuit diagram illustrating the pixel unit circuit under the external compensation manner according to the embodiments of the present disclosure. As illustrated in (b) of FIG. 10, the light-emitting device is the OLED device, the first transistor T2, the second transistor T3 and the third transistor T4 are turned on at this time, the driving transistor T1 and the fourth transistor T5 are turned off; a voltage difference between the anode and the cathode of the OLED device is biased as $V_{REF}-V_{ELVSS}$, and the current flowing through the OLED device is input into the data line through the second transistor T3, so that the external sensing chip connected to the data line may sense this current value and perform further processing.

Figure 11:
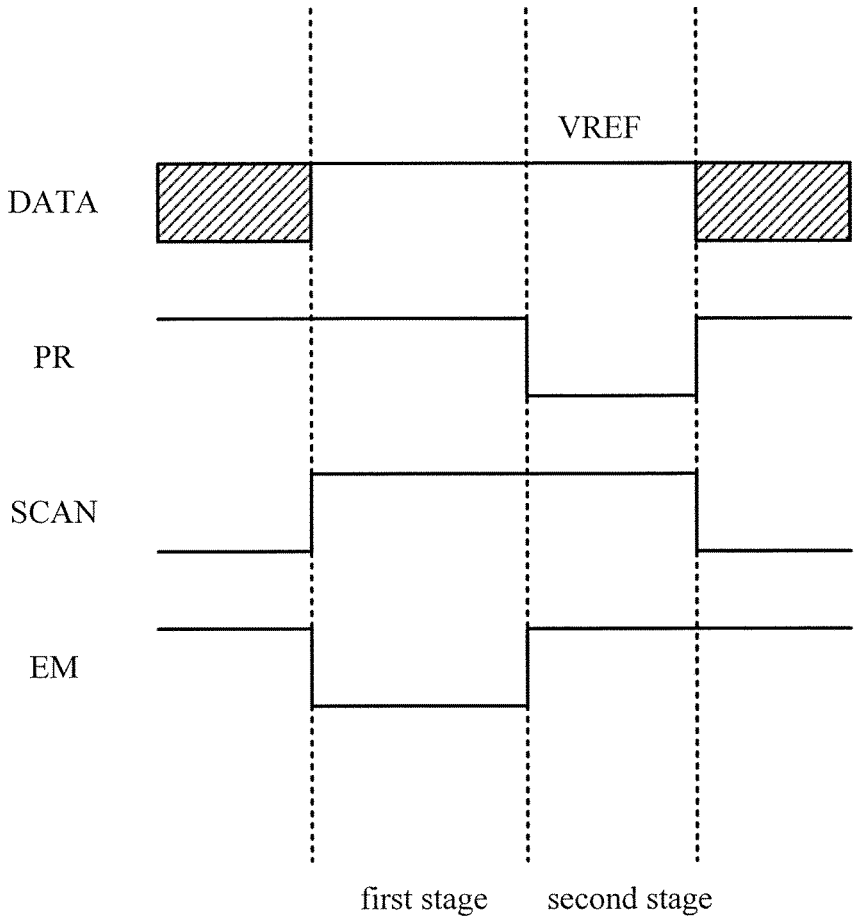
FIG. 11 is a control signal timing diagram of the compensating method for the pixel unit circuit under the external compensation manner according to the embodiments of the present disclosure.

FIG. 11 is a control signal timing diagram of the compensating method for the pixel unit circuit under the external compensation manner according to the embodiments of the present disclosure. As illustrated in FIG. 11, the control timings for the light-emitting control signal EM, the pre-charging control signal PR and the scan control signal SCAN are:

during a first stage, which corresponds to the step S310 for extracting a current from the driving transistor T1, the light-emitting control signal EM is in a low level, the pre-charging control signal PR and the scan control signal SCAN are in a high level; and during a second stage, which corresponds to the step S320 for extracting a current from the OLED device, the light-emitting control signal EM and the scan control signal SCAN are in a high level, and the pre-charging control signal PR is in a low level.

It can be seen from above, such pixel unit circuit may be operated with the two operation modes of the internal compensation and the external compensation, therefore its compensation effect may have the advantages of both of them.

In the embodiments of the present disclosure, there is further provided a display device comprising the pixel unit circuit according to the embodiments of the present disclosure and compensating the pixel unit circuit by the compensating method according to the embodiments of the present disclosure.

The embodiment of the invention being thus described, it will be obvious that the same may be varied in many ways. Such variations are not to be regarded as a departure from the spirit and scope of the invention, and all such modifications as would be obvious to those skilled in the art are intended to be included within the scope of the following claims.

What is claimed is:

1. A pixel unit circuit comprising a driving transistor, a first transistor, a second transistor, a third transistor, a fourth transistor, a storage capacitor and a light-emitting device, wherein, a drain of the driving transistor is connected with a source of the fourth transistor, a source thereof is connected with a drain of the third transistor, and a gate thereof is connected with a first terminal of the storage capacitor and a source of the first transistor;

a drain of the first transistor is connected with the source of the fourth transistor, the source thereof is connected with the gate of the driving transistor, and a gate thereof is connected with a scan control signal line;

a drain of the second transistor is connected with a data line, a source thereof is connected with the source of the driving transistor and the drain of the third transistor, and a gate thereof is connected with the scan control signal line;

the drain of the third transistor is connected with the source of the driving transistor a source thereof is connected with an anode of the light-emitting device, and a gate thereof is connected with a light-emitting control signal line;

a drain of the fourth transistor is connected with a first power supply voltage, the source thereof is connected with the drain of the driving transistor and the drain of the first transistor, and a gate thereof is connected with a pre-charging control signal line, wherein a signal on the pre-charging control signal line is different from a signal on the light-emitting control signal line;

the first terminal of the storage capacitor is connected with the gate of the driving transistor, and a second terminal thereof is connected with the first power supply voltage;

a cathode of the light-emitting device is connected with a second power supply voltage, wherein the pixel unit circuit operates in an internal compensation manner when the light-emitting device is in an operation stage for light-emitting normally, and the pixel unit circuit operates in an external compensation manner when the light-emitting device is in an operation stage of a panel reset or an operation stage of an idle display between frames or rows, the internal compensation manner is different from the external compensation manner.

2. The pixel unit circuit of claim 1, wherein the light-emitting device is an Organic Light-Emitting Diode device.

3. A compensating method for the pixel unit circuit of claim 1, comprising:

selecting a compensation manner according to an operation stage of a light-emitting device, wherein the compensation manner comprises the internal compensation manner and the external compensation manner;

compensating the light-emitting device with the internal compensation manner, if the light-emitting device is in an operation stage for light-emitting normally; and compensating the light-emitting device with the external compensation manner, if the light-emitting device is in an operation stage of a panel reset or an operation stage of an idle display between frames or rows.

4. The compensating method for the pixel unit circuit of claim 3, wherein said compensating the light-emitting device with the internal compensation manner further comprises:

pre-charging the driving transistor;

performing a voltage compensation or a current compensation on the driving transistor; and performing a voltage compensation or a current compensation on the light-emitting device, in order to assist the light-emitting device to emit light.

5. The compensating method for the pixel unit circuit of claim 4, wherein said pre-charging the driving transistor further comprises:

setting a light-emitting control signal as a low level to turn off the third transistor; setting a pre-charging control signal as a high level to turn on the fourth transistor; setting a scan control signal as a high level to turn on the first transistor and the second transistor; and making a voltage at the source of the driving transistor be a voltage $V_{DATA}$ on the data line.

6. The compensating method for the pixel unit circuit of claim 4, wherein said performing a voltage compensation or a current compensation on the driving transistor further comprises:

setting a light-emitting control signal as a low level to turn off the third transistor; setting a pre-charging control signal as a low level to turn off the fourth transistor; setting a scan control signal as a high level to turn on the first transistor and the second transistor; and making a voltage at the gate of the driving transistor be $V_{DATA}+$ $V_{thn}$, wherein $V_{DATA}$ is the voltage on the data line, and $V_{thn}$ is a threshold voltage of the driving transistor.

7. The compensating method for the pixel unit circuit of claim 4, wherein said performing a voltage compensation or a current compensation on the light-emitting device in order to remain the light-emitting device to emit light further comprises:

setting a light-emitting control signal as a high level to turn on the third transistor; setting a pre-charging control signal as a high level to turn on the fourth transistor; setting a scan control signal as a low level to turn off the first transistor and the second transistor; and making a current $I_{OLEO}$ input to the light-emitting device through the driving transistor be:

$$I_{OLED} = \frac{1}{2} \cdot \mu_n C_{OX} \cdot \frac{W}{L} \cdot [V_{DATA} - V_{OLED}]^2,$$

wherein $\mu_n$ is a mobility of carriers, $C_{OX}$ is a capacitance value of the storage capacitor in an oxide layer at the gate, $$\frac{W}{L}$$

is a width-length ratio of the driving transistor, $V_{DATA}$ is a voltage on the data line $V^{OLED}$ is a voltage at the anode of the light-emitting device.

8. The compensating method for the pixel unit circuit of claim 3, wherein said compensating the light-emitting device with the external compensation manner further comprises:

extracting a current from the driving transistor;

extracting a current from the light-emitting device; and detecting the current extracted from the driving transistor or the light-emitting device, and performing a voltage compensation or a current compensation on the light-emitting device according to a value of the detected current.

9. The compensating method for the pixel unit circuit of claim 8, wherein said extracting a current from the driving transistor further comprises:

setting a light-emitting control signal as a low level to turn off the third transistor; setting a pre-charging control signal as a high level to turn on the fourth transistor; setting a scan control signal as a high level to turn on the first transistor and the second transistor; and enabling a current of the driving transistor to be input to the data line while shielding a current of the light-emitting device from being input to the data line.

10. The compensating method for the pixel unit circuit of claim 9, wherein said extracting a current from the light-emitting device further comprises:

setting a light-emitting control signal as a high level to turn on the third transistor; setting a pre-charging control signal as a low level to turn off the fourth transistor; setting a scan control signal as a high level to turn on the first transistor and the second transistor; and enabling a current of the light-emitting device to be input to the data line while shielding a current of the driving transistor from being input to the data line.

11. The compensating method for the pixel unit circuit of claim 3, wherein the light-emitting device is an Organic Light-Emitting Diode device.

12. A display device comprising the pixel unit circuit of claim 1.

* * * * *